US007600367B2

(12) United States Patent
Welch et al.

(10) Patent No.: US 7,600,367 B2
(45) Date of Patent: Oct. 13, 2009

(54) WOVEN PLASTIC BAG FABRIC

(75) Inventors: Diana L Welch, Houston, TX (US); Joan Doreen Welch, Baltimore, MD (US)

(73) Assignee: Re Use Everything Manufacturing, Co., Houston, TX (US)

( * ) Notice: Subject to any disclaimer, the term of this patent is extended or adjusted under 35 U.S.C. 154(b) by 0 days.

(21) Appl. No.: 12/266,241

(22) Filed: Nov. 6, 2008

(65) Prior Publication Data

US 2009/0123095 A1 May 14, 2009

Related U.S. Application Data

(60) Provisional application No. 60/987,787, filed on Nov. 14, 2007.

(51) Int. Cl.
*D02G 3/06* (2006.01)

(52) U.S. Cl. ..... 57/260

(58) Field of Classification Search ..... 57/260; 139/29, 33, 34

See application file for complete search history.

(56) References Cited

U.S. PATENT DOCUMENTS 2,198,624 A * 4/1940 Grover ..... 139/33
2,199,515 A * 5/1940 Woods ..... 139/34
2,424,880 A * 7/1947 Robertson ..... 139/33
2,427,093 A * 9/1947 Eckert ..... 28/152
2,601,715 A * 7/1952 Simonds ..... 28/152
2,780,854 A * 2/1957 Dritz ..... 28/152

OTHER PUBLICATIONS http://plastemart.com/upload/Literature/Plastic_Weaving_Unit_Profile.asp; "Innovation in Recycling Technology"; 2003.

http://news.yahoo.com/s/ap/20071022/ap_on_hi_te/green_plastic&printer; "Green plastics find cautious markets"; 2007.

* cited by examiner

*Primary Examiner*—Shaun R Hurley
(74) *Attorney, Agent, or Firm*—Buskop Law Group, PC; Wendy Buskop

(57) ABSTRACT

A woven plastic bag fabric and method for weaving using a frame with a moveable upper bar, at least two continuous ribbons of plastic bag, by winding a first ribbon without cutting around a post in the fourth frame side around a long post in the first frame side, then another post in the fourth frame side and around a short post in the first frame side until all posts in the first and fourth frame side are used. The movable bar is raised to form a space. A second ribbon is tied to either a second or third frame side, and the second ribbon is threaded through the space around a right edge post, the moveable bar is lowered to form a second space, the second ribbon is threaded through the second space and the threading and movement is repeated until all edge posts are used forming the fabric.

13 Claims, 9 Drawing Sheets

WOVEN PLASTIC BAG FABRIC

CROSS REFERENCE TO RELATED APPLICATIONS

The present application claims priority to co-pending U.S. Provisional Patent Application Ser. No. 60/987,787 filed on Nov. 14, 2007; entitled: "Woven Plastic Bag Fabric" and is incorporated herein.

FIELD

The present embodiments relate to a fabric made from woven plastic bags and a method for manufacturing sheets of woven plastic.

BACKGROUND

A need exists for a fabric made from woven plastic bags that can be used to fashion articles that are lightweight, visually appealing, texturally appealing, individually unique, and easy to manufacture.

A further need exists for a fabric made from clean household discards, including non-biodegradable plastic grocery bags, that would otherwise occupy a landfill.

A need also exists for a fabric and a method of making a fabric that can be performed safely and easily, from a manufacturer's home, with a minimum of specialized equipment and special training.

The present embodiments meet these needs.

BRIEF DESCRIPTION OF THE DRAWINGS

The detailed description will be better understood in conjunction with the accompanying drawings as follows.

Figure 1:
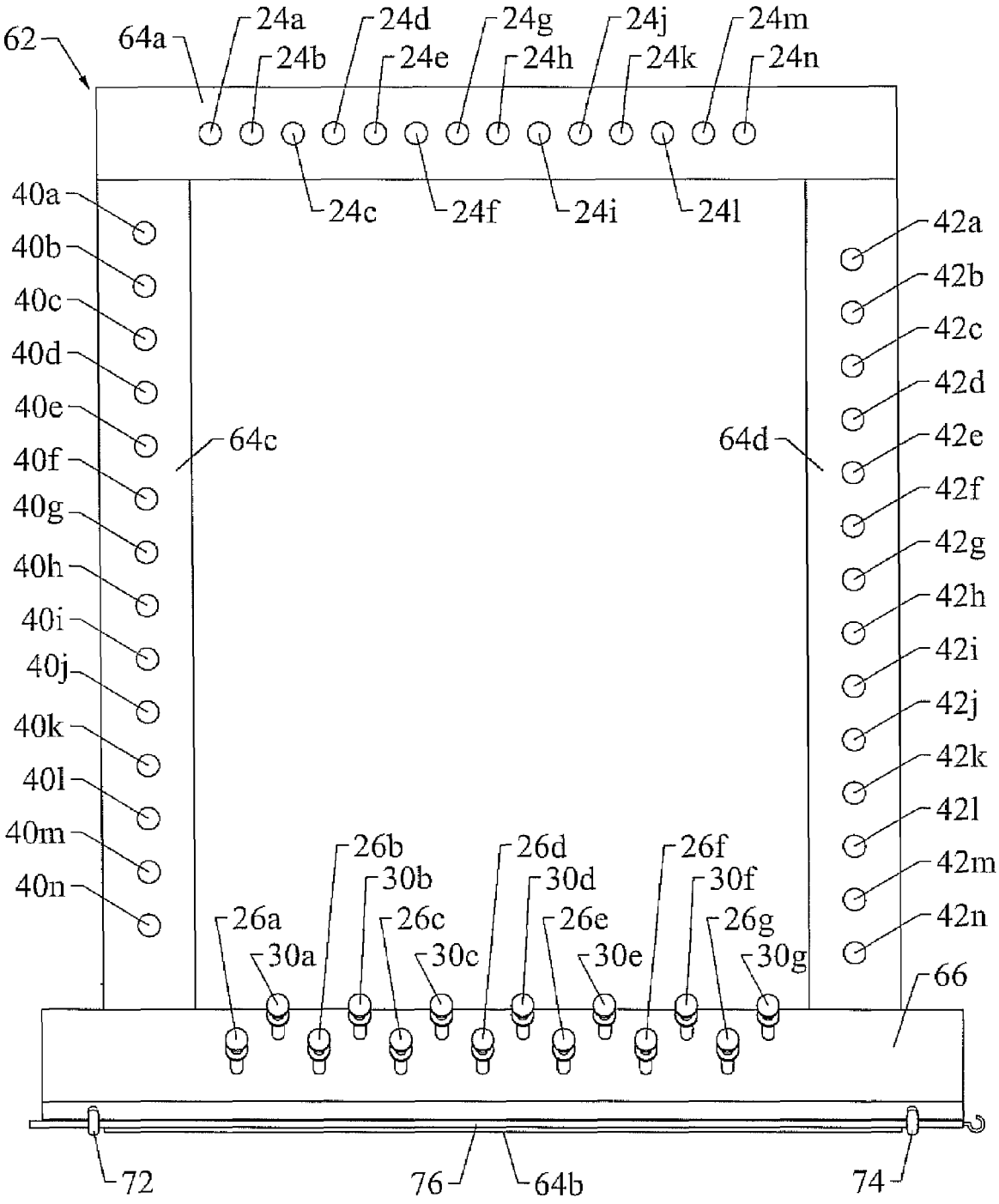
FIG. 1 depicts a top view of a frame having posts with heads which can be used to form the present woven plastic bag fabric.

The present embodiments are detailed below with reference to the listed Figures.

DETAILED DESCRIPTION OF THE EMBODIMENTS

Before explaining the present apparatus in detail, it is to be understood that the apparatus and method are not limited to the particular embodiments and that it can be practiced or carried out in various ways.

The present embodiments generally relate to a fabric, which can be made from woven plastic bags, such as plastic grocery bags and similar flexible plastic items, and a method for making sheets of the woven plastic bag fabric.

The embodiments are designed to provide work, which can be for poor home bound women with an ability to create a product that can be used to make handbags and placemats using easily obtainable plastic bags.

The embodiments are further designed to use a loom made from a frame that is fast and easy to assembly and use, so that a person, with limited abilities, can make the loom and a product quickly.

As manufacturing jobs go overseas, there are very few "unskilled" jobs for "unskilled" laborer. There are even fewer unskilled jobs that can use materials that clog landfills, and pollute the rivers and oceans, to make a high quality product that makes enough money to pay underprivileged workers a decent wage, while working from their home in a clean environment.

The embodiments can be particularly usable for people with limited or no income and limited or no education or training.

The embodiments do not require any fossil fuels to create a product. It does not require electricity. The invention is not designed for electric operation, it is a hand loom, which can be assembled by poor unskilled, untrained, people using a hammer, and operated by hand.

The invention can help provide a cleaner environment by utilizing plastic bags which could otherwise pollute the environment. The invention is superior to other inventions that use plastic bags, because the present invention does not require the use of more energy to remanufacture materials. These embodiments of the invention do not require any heat or any mixing through the use of electricity, or any other carbon dioxide producing energy source to create the resulting product of the invention.

The fabric can be contemplated for use in handbags, in sheets, use for outdoor sheets and tarps, and can provide many opportunities to reuse the bags making high end, elegant materials.

The embodiments are designed to use easily obtainable materials, such as, about 2 inch to about 3 inch nails, which can be from a hardware store prefabricated stretcher strips as the frame can be available from art supply houses for only about $2.00 to about $4.00 US dollars, push pins, which can be from an office supply store which can all be utilized to create a kit that a person can assemble. Only a hammer needs to be used and a hand drill to make holes. The person can even pre-drill the holes to make these kits for looms usable for the plastic bag weaving. An inventive feature is the "lightweight" and fast to assemble feature of the kit, and of the loom usable herein.

The embodiments contemplate using continuous strips of plastic bags as the ribbon for weaving. The bags can be all the same color, such as blue. The continuous strips of plastic bags as ribbon for weaving can be multiple colors. The plastic bags can be found virtually every where, such as any retail store, grocery store, department stores and are usually found discarded, therefore being extremely cost effective to create a waterproof woven fabric.

The embodiments can further combine the environmental advantage of also cleaning up landfills, and removing the high disposal rate by using these discarded items.

A woven plastic bag fabric and method for weaving using a frame with a moveable upper bar, at least two continuous ribbons of plastic bag, by winding a first ribbon without cutting around a post in the fourth frame side around a long post in the first frame side, then another post in the fourth frame side and around a short post in the first frame side until all posts in the first and fourth frame side are used. The movable bar is raised to form a space. A second ribbon is tied to either a second or third frame side, and the second ribbon is threaded through the space around a right edge post, the moveable bar is lowered to form a second space, the second ribbon is threaded through the second space and the threading and movement is repeated until all edge posts are used forming the fabric.

The present fabric and method beneficially utilizes clean household discards that would otherwise occupy space in a landfill, such as plastic grocery bags, plastic newspaper bags, plastic bottles and caps, and similar discarded plastic items, to form lightweight, recyclable, tear and snag-resistant sheets of fabric that can be used to manufacture articles, such as handbags, tote bags, and placemats.

Each year, Americans throw away some 100 billion polyethylene plastic bags, of which only about 0.6 percent are recycled.

Large volumes of discarded plastic goods can require a large quantity of hydrocarbon-based fuels, such as oil, to produce and refine. When discarded, this plastic does not biodegrade for hundreds, if not thousands of years, occupying limited space in landfills and posing a potential danger to wildlife, such as birds and fish.

While some types of plastic can be recycled, the process of melting plastic and molding or extruding new plastic articles requires energy, and often, the articles formed from recycled plastic have a less pleasant appearance or diminished performance compared to articles formed from new plastic.

The present fabric and method utilize clean plastic discards without requiring an energy-consuming recycling process. Plastic materials, such as plastic grocery bags, can be cut and tied to form ribbons, which can then be woven to form sheets of fabric that can be used to fashion articles.

The present fabric and method require a minimum amount of space, equipment, and training to utilize. Using only simple materials, such as wooden frames with nails, or frames made from recycled plastic, such as plastic water bottles, via injection molding, a single individual can create a woven sheet of plastic bag fabric in about one hour.

Any small space, such as neighborhood church space, a community center space, or an individual's home, can be used to manufacture the woven plastic bag fabric.

The present fabric can be created without requiring any special skills or training, allowing individuals from underserved neighborhoods to produce the present fabric for extra income, on a flexible, piecework basis. Individuals making the present fabric can safely and efficiently perform this task in their homes, such as while caring for children.

The present fabric and method additionally possess the advantage of being useable to create unique, "one-of-a-kind" articles. Each piece of clean discarded plastic can have a unique combination of colors in a unique pattern, and a unique combination of textures. Pieces of clean plastic can be selected to form woven plastic fabric sheets having selected coloration and patterns, allowing unique articles to have a customized appearance. Decorative materials, such as glittery threads or reflective materials, can be woven with or in place of one or more plastic ribbons to further customize and decorate an article.

The present woven plastic fabric is further advantageously lightweight. While conventional hand bags, tote bags, and similar articles made from leather, canvas, other fabrics and textiles can be heavy, the present woven plastic fabric can be made from thin ribbons of polyethylene or another type of plastic and still possess equal or greater strength and functionality alongside heavier fabrics.

The present woven plastic bag fabric is water resistant, able to withstand exposure to humidity and moderate precipitation while protecting any contents or covered items from moisture. Conventional fabrics and leather can quickly soak through when exposed to precipitation, while the present woven plastic bag fabric does not absorb water.

The present woven plastic bag fabric is machine-washable without deforming, able to withstand the moisture, physical stresses, and temperature of a washing machine without tearing, stretching, melting, or otherwise deforming, while conventional fabrics may tear, stretch, or experience shrinking.

It is contemplated that the woven plastic bag fabric can withstand temperatures of up to about 105 degrees Fahrenheit without melting or deforming. In an embodiment, the present woven plastic bag fabric can withstand temperatures of up to about 120 degrees Fahrenheit, or more, without melting or deforming.

The present woven plastic bag fabric can also dry rapidly after machine washing, while conventional fabrics that cannot be quickly dried using heat may remain waterlogged for hours, attracting mold and mildew, diminishing in appearance, and acquiring unpleasant odors.

The present woven plastic bag fabric can further be tear-resistant, able to resist stretching beyond about three percent of its length or width, while having sufficient flexibility and tensile strength to bend or yield when pulled or caught, thereby avoiding becoming torn.

The flexibility of the present woven plastic bag fabric can also allow the fabric to be foldable for easy and compact storage.

The present woven plastic bag fabric can be smooth in texture for ease of handling and snag-resistance, avoiding becoming caught, snagged or pulled on objects that can damage a more coarse or rough fabric.

The present woven plastic bag fabric can be recyclable, should any article become damaged beyond usability.

The present woven plastic bag fabric can include a longitudinal flexible ribbon of connected plastic bags, where a single bag can be cut into a long, continuous strip to form the longitudinal flexible ribbon. Multiple bags can be cut into long, continuous strips and tied together to form ribbons of greater length.

In an embodiment a sheet of the present woven plastic bag fabric can be formed from ribbons made using multiple plastic bags.

The longitudinal flexible ribbon of connected plastic bags can be formed by cutting from about one to about twenty plastic bags, such as about twelve plastic polyethylene grocery bags, into continuous strips. An automated or manually-operated cutting apparatus can be used for cutting multiple strips from plastic bags simultaneously, or the plastic bags can be cut manually, such as by using a knife, scissors, or a similar sharp edge.

An embodiment of the cutting apparatus can form one continuous ribbon having a width of about one inch from a single plastic bag. In an embodiment, the cutting apparatus can be a mechanical, cylindrical rotating device mounted to a board. In another embodiment, the cutting apparatus can be an electrical cutting machine.

The plastic strips can then be tied, sewed, stitched, or adhered together longitudinally to form the longitudinal flexible ribbon of connected plastic bags.

The total length of the longitudinal flexible ribbon of connected plastic bags can range from about 72 inches to about 100 inches, or more, depending on the size of the plastic bag and the desired size of the completed sheet of woven fabric. The width of the longitudinal flexible ribbon of connected plastic bags can range from about 0.25 inches to about 4 inches, but can also vary depending on the size of the plastic sheet and the desired size of the completed sheet of woven fabric.

The longitudinal flexible ribbon of connected plastic bags can be contemplated to be thin, ranging from about 0.5 millimeters to about 3 millimeters in thickness. Use of thicker ribbons can also be contemplated, when the formation of stiffer articles, having less flexibility, is desired.

The longitudinal flexible ribbon of connected plastic bags can be made from colored plastic bags, such as plastic bags having one or more colors, patterns, or logos disposed thereon. Colored ribbons can be used to produce articles having a customized, visually appealing appearance, such as a hand bag made from a mixture of brown plastic grocery bags and white plastic newspaper bags.

The longitudinal flexible ribbon of connected plastic bags can also be colored, such as by dying or painting, prior to use. A logo, pattern, or symbol, such as advertorial material, can also be painted onto a finished woven sheet or article.

The present woven plastic bag fabric can also include a transverse flexible ribbon of connected plastic bags woven together with the longitudinal flexible ribbon of connected plastic bags in an interlaced fashion.

The transverse flexible ribbon of connected plastic bags can have the same dimensions and materials as the longitudinal flexible ribbon of connected plastic bags.

In an embodiment, the transverse flexible ribbon of connected plastic bags can be made from a different plastic material, have differing coloration or patterns, or have differing dimensions than the longitudinal flexible ribbon of connected plastic bags.

The interlacing of the longitudinal and transverse flexible ribbons of connected plastic bags can form a sheet of lightweight, recyclable, tear and snag-resistant woven plastic fabric that can be resistant to stretching, water resistant, and washable in a washing machine without deforming.

In a contemplated embodiment, one of the flexible ribbons of connected plastic bags can be woven with one or more glittery threads, such as reflective ribbons, colored threads, threads that are at least partially metallic, or similar materials, to produce a woven plastic bag fabric with at least one deliberate bright color and light reflecting effect.

It is also contemplated that one or more glittery threads can be woven in place of one of the flexible ribbons of connected plastic bags.

In an embodiment, the flexible ribbons of connected plastic bags can be smooth in texture for ease of handing, for forming a soft, non-brittle surface, and for promoting snag resistance.

The present embodiments can also relate to articles made from the present woven plastic bag fabric, such as handbags, tote bags, placemats, beach bags, stadium seat covers, beach mats, change purses, table runners, napkins, shawls, coasters, covers for magazine holders, window coverings, tissue box covers, floor mats, rain ponchos, and other similar articles.

It is contemplated that an article can be made by providing sheets of the woven plastic bag fabric with an edging, such as by applying adhesive tape along the edges of sheets of the woven plastic bag fabric.

The edges of multiple sheets of woven plastic bag fabric can then be stitched together to form articles of any size. For example, two sheets of woven plastic bag fabric can be used to form a mat having dimensions of about four feet by about two feet.

The flexibility of the woven plastic bag fabric can further allow formed articles to have any shape. For example, five sheets of woven plastic bag fabric can be used to fashion a pyramid-shaped covering for a flotation device.

The unique coloration and patterns disposed on each flexible ribbon of connected plastic bags can allow each formed article to have a unique, visually appealing appearance, such as a chessboard pattern. By selecting flexible ribbons of connected plastic bags having certain colors or patterns, or by coloring one or more flexible ribbons of connected plastic bags, articles having a customized appearance can be formed.

The present embodiments also relate to a method for producing a woven plastic bag sheet formed from flexible ribbons of plastic bags. The present method is simple and fast, easy to use, enabling a single individual with no special training to produce a sheet of woven plastic bags in about one hour using recycled materials.

The present method conserves energy, recycling plastic that can otherwise occupy limited space in a landfill without requiring melting, molding, or extrusion.

The method can include forming at least two flexible ribbons of connected plastic bags. It is contemplated that the formed flexible ribbons of connected plastic bags can be resistant to stretching during use, stretching no more than about 3 percent of the length of the flexible ribbons of connected plastic bags prior to use. The width of each flexible ribbon of connected plastic bags can range from about 0.25 inches to about 4 inches.

Each flexible ribbon of connected plastic bags can be formed by cutting plastic bags into strips having a width, such as about one inch, and tying or attaching the strips longitudinally, as described previously.

The method can then include tying one of the flexible ribbons of connected plastic bags to a first longitudinal post with a head. The post with a head can be a nail, a wooden dowel with a wooden top, a plastic post with a head, and other similar essentially rigid structures. Each post can have a height ranging from about 0.5 inches to about 3 inches. Each post can have a diameter ranging from about 0.01 inches to about 0.25 inches. In an embodiment one or more of the posts can have diameters or heights different from other posts.

Each post with a head can be contemplated to withstand horizontal stress from the flexible ribbons of connected plastic bags without bending or breaking.

The heads of each post can vary in diameter, ranging from about 0.15 inches to about 0.25 inches. In an embodiment, the heads of one or more of the posts with heads can have differing diameters from other posts with heads.

In an embodiment, each of the posts with heads can be disposed on a wooden or plastic frame having up to four sides. Each side can have a row of nails or other types of posts with heads.

In an embodiment, three sides of the frame can have one type of post, such as one-inch nails hammered about 0.25 inches into the frame, having heads with a diameter of about 0.125 inches. The fourth side of the frame can have larger posts, such as nails having a length of three inches which protrude from about 0.25 inches to about 1.5 inches from a moveable bar disposed over the fourth side of the frame, and about 3 inches from the frame. The fourth side can also have a second row of posts that protrude about 1.5 inches from the moveable bar that engage the moveable bar while not engaging the fourth side of the frame, to allow movement of the second row of posts.

In an embodiment, each of the posts on the fourth side of the frame and the moveable bar can have a head diameter of about 0.25 inches.

In a further embodiment, each of the posts on the fourth side of the frame can have a second head disposed about 0.25 inches to about 0.5 inches beneath the first head. The first head and the second head can form a groove preventing the flexible ribbons of plastic bags from vertically sliding off of the posts or becoming caught or abraded against the moveable bar.

The flexible ribbon of connected plastic bags can then be wound from the first longitudinal post with a head to a second longitudinal post with a head opposite the first longitudinal post with a head.

The flexible ribbon of connected plastic bags can then be wound around a third longitudinal post with a head opposite the second longitudinal post with a head and adjacent the first longitudinal post with a head.

The flexible ribbon of connected plastic bags can then be wound around a moveable fourth longitudinal post with a head opposite the third longitudinal post with a head and adjacent the second longitudinal post with a head.

The present method can include continuing to wind the flexible ribbon of connected plastic bags without cutting until all posts adjacent the first longitudinal post with a head, such as all posts along a first edge of a wooden or plastic frame, and all posts adjacent the second longitudinal post with a head, such as all posts along second edge of the frame opposite the first edge, have been wrapped with the flexible ribbon of connected plastic bags, forming a plurality of longitudinal rows of ribbon.

The flexible ribbon of connected plastic bags can then be tied to a last longitudinal post with a head.

The moveable fourth longitudinal post with a head and all moveable posts with a head adjacent the fourth longitudinal post with a head can then be raised while connected to the flexible ribbon of connected plastic bags. For example, the forth longitudinal post with a head and each alternate longitudinal post with a head along the same edge of a frame as the fourth longitudinal post with a head can be moveable, while all other longitudinal posts with heads along the same edge of the frame as the fourth longitudinal posts with a head are non-moveable.

In an embodiment, the fourth longitudinal post with a head and all other moveable longitudinal posts with heads can be non-removably affixed in a moveable bar disposed over an edge of the frame. Each non-moveable post can penetrate through the moveable bar to secure to the side of the frame beneath the wooden bar.

It is also contemplated that in an embodiment, the fourth longitudinal post with a head and all moveable posts with heads can be offset from a row of non-moveable posts along the same edge of the frame by a distance ranging from about 0.25 inches and about 0.5 inches along a thread axis extending between the second post with a head and the fourth post with a head.

The raising of the fourth longitudinal post with a head and all adjacent moveable posts with heads forms a first vertical space between the flexible ribbon connected to the raised posts and the flexible ribbon connected to non-moveable posts. The vertical space can have a height ranging from about 0.25 inches to about 0.5 inches.

The present method can include inserting a threaded dowel, such as a wooden, plastic, or metal rod with a hook, nail, clip, or similar threading means on one end, with a second flexible ribbon of connected plastic bags through the vertical space. The dowel can be thin enough to fit through the vertical space easily, having a diameter ranging from about 3/16ths of an inch to about 5/16ths of an inch.

After inserting the second flexible ribbon of connected plastic bags through the vertical space, the second flexible ribbon of connected plastic bags can be tied around a first right edge post with a head positioned about 90 degrees from the first longitudinal post with a head, such as on a wooden or plastic frame along an edge perpendicular to the edge on which the first longitudinal post with a head is disposed.

The second flexible ribbon of connected plastic bags can then be wrapped around a first left edge post with a head also positioned about 90 degrees from the first longitudinal post with a head and opposite the first right edge post with a head, such as along an edge of a wooden or plastic frame opposite the edge on which the first left edge post with a head is disposed.

The fourth longitudinal post with a head and all adjacent moveable posts are then lowered, intermeshing the threaded portion of second flexible ribbon of connected plastic bags with the plurality of longitudinal rows and forming a second vertical space. The second vertical space is contemplated to have similar dimensions to the first vertical space, however in an embodiment, the second vertical space can have a different height from the first vertical space.

The threaded dowel can then be inserted through the second vertical space with the second flexible ribbon of connected plastic bags. The second flexible ribbon of connected plastic bags can be wrapped around a subsequent right edge post and a subsequent left edge post.

The present method can then include repeating the steps of raising or lowering the fourth longitudinal post with a head and all adjacent moveable posts, threading the second flexible ribbon of connected plastic bags through the resulting vertical space with the dowel, and wrapping the second flexible ribbon of connected plastic bags around two opposing edge posts with heads, until all left and right edge posts with heads are wrapped with the second flexible ribbon of connected plastic bags, forming a sheet.

An adhesive tape can be applied around the perimeter of the sheet. Each flexible ribbon of connected plastic bags can then be cut from all of the posts with heads at a position between the posts with heads and the adhesive tape. The adhesive tape can form an edging for the cut sheet, allowing sewing of the sheet.

In an embodiment, each of the posts with heads can be disposed in a generally rectangular wooden frame with four sides. The moveable posts with heads adjacent the fourth post with a head are non-removably affixed to a moveable bar disposed over one side of the frame. The non-moveable posts adjacent the fourth post with a head penetrate through the moveable bar such that the non-moveable posts do not move when the moveable bar is raised or lowered.

Each post with a head can be spaced apart from each adjacent post. In an embodiment, each post with a head can be spaced apart from each adjacent post by the same distance, such as about 0.25 inches. In an additional embodiment, the ratio of space between posts and the width of each flexible ribbon of connected bags can be 1:2.

It is contemplated that in an embodiment, a first eye can be connected to one end of the moveable bar and a second eye can be connected to a second end of the moveable bar in the same plane as the first eye. A rod can be disposed through and between the eyes, forming a holder for ribbon during weaving. The rod can have any diameter equal to or smaller than the diameter of the first and second eye.

The present embodiments also relate to an article, which can be made from the sheets formed using the present method, such as handbags, tote bags, and placemats. As described previously, articles can be formed by sewing or stitching multiple cut sheets having edging, such as adhesive tape, together.

The embodiments can further contemplate a method for producing a woven plastic bag sheet comprised of flexible ribbons of plastic bags. First, a loom is created using a fast assembly.

The fast assembly, lightweight loom can be a wooden loom for weaving, which can have a first side by positioning a moveable bar over a first frame side, wherein the moveable frame can be of substantially the same size as the base frame.

A first row of holes can be drilled though the moveable bar and into the first frame and a second row can be drilled parallel to and offset from the first row of holes through the moveable bar.

A plurality of long posts, which can comprise long shafts and heads can then be inserted through the first row of holes, enabling the moveable bar to slide up and down on the long shaft.

The embodiments can further comprise a plurality of short posts, which can comprise short shafts and heads can then be inserted through the second row of holes providing a fixed support for winding ribbon for weaving.

The fast assembly can have a second side of the loom by disposing a plurality of left edge posts with heads into a second frame side. The assembly can have a third side of the loom disposing a plurality of right edge posts with heads into a third frame side. The assembly can further have a forth side of the loom by disposing a plurality of right edge posts with heads into a fourth frame side.

In an embodiment, the second and third sides can be connected to the first side, and the second and third side can be connected to the forth side of the loom.

The frame of the formed wooden loom can be square or rectangular. Additional shapes can be used if an additional shape is needed.

The next step of the method can be to form at least two flexible ribbons of connected plastic bags, wherein the ribbon can be resistant to stretching during use to no more than about 3 percent of the length of the flexible ribbon of connected plastic bags prior to use, and wherein the flexible plastic ribbon of connected plastic bags can have a width ranging from about 0.25 inches to about 4 inches.

The next step of the method can be to tie a first of the flexible ribbons of connected plastic bags to a first longitudinal post with a head on the fourth frame side, and then wind the first flexible ribbon of connected plastic bags from the first longitudinal post with a head to a long post on the first frame side opposite the first longitudinal post with a head and then to a second longitudinal post with a head in the fourth frame side adjacent the first longitudinal post with a head opposite the longitudinal post with a head, and then to a short post positioned offset from the long post and opposite the third longitudinal post with a head and continuing to wind the first flexible ribbon of connected plastic bags without cutting from the fourth frame to first a long post, and then adjacent short post, until all posts disposed in first and fourth frame sides are used forming a plurality of longitudinal rows of ribbon.

In the method, the flexible ribbon of connected plastic bags can then be tied to a last longitudinal post with a head in the fourth frame.

One the flexible ribbon is ready to be used, the method can further contemplate: raising the moveable bar while connected to the first flexible ribbon of connected plastic bags to form a first vertical space between the flexible ribbon of connected plastic bags connected to the long posts and the flexible ribbon connected to the short posts Then the method can continue by inserting a threaded dowel with a second flexible ribbon of connected plastic bags horizontally through the first vertical space.

Then the method can continue by tying the threaded second flexible ribbon of connected plastic bags around a first right edge post with a head positioned about 90 degrees to the first post of the fourth frame.

The method can continue by wrapping the threaded second flexible ribbon of connected plastic bags around a first left edge post with a head positioned about 90 degrees to the first post with a head.

Then the method can continue by lowering the fourth longitudinal post with a head and all posts with a head adjacent to the fourth longitudinal post with a head to form a second vertical space.

The method can continue by inserting the threaded dowel with the second flexible ribbon of connected plastic bags horizontally through the second vertical space.

Then the method can continue by wrapping the threaded second flexible ribbon of connected plastic bags around a subsequent right edge post with a head.

The method can continue by wrapping the threaded second flexible ribbon of connected plastic bags around a subsequent left edge post with a head.

Finally, the steps can be repeated, until all posts with heads are wrapped with the second flexible ribbon of connected plastic bags forming a sheet.

Once the sheet is produced, the method can further comprise applying an adhesive tape around the perimeter of the sheet and cutting the first flexible ribbon of connected plastic bags and the second flexible ribbon of connected plastic bags from all the posts with heads at a position between the posts with heads and the adhesive tape, wherein the adhesive tape forms an edging, which can allow sewing of the sheet, forming a finished sheet in under one hour.

In an embodiment, the short and long posts can be nails. The long posts can range between about 2 inches to about 4 inches The short posts can be about 1 inch to about 1.5 inches.

The long posts can have a head positioned adjacent the short post with a head at an offset location between about 0.25 inches and about 0.5 inches along the thread axis from a plane between the long and short posts.

In an additional embodiment, the short posts can be push pins. In this embodiment, the push pins can be mounted on a wooden strip which can be secured to the moveable frame.

The short posts, or push pins can be used for all the right edge, left edge, and longitudinal posts. In an embodiment of the method, the first, second and third longitudinal posts can also be push pins.

The ratio of space between the right edge and the left edge posts and width of the flexible ribbon of connected plastic bags can be about 1:2. In an embodiment, the space between the right edge and left edge posts can be the same width as the flexible ribbon of connected plastic bags.

In an additional embodiment, the method can further comprise a first eye, which can be connected to one end of the moveable bar and a second eye, which can be connected to a second end of the moveable bar in the same plane as the first eye, and wherein a rod can be disposed through and between the eyes forming a holder for ribbon during weaving.

In an embodiment, prefabricated stretcher strips can be used for the base, second, third and fourth frame sides in forming the loom.

In an embodiment the a threaded seam can be sewn over the adhesive edging.

Referring now to FIG. 1, a top view of an embodiment of a generally rectangular wooden frame having posts with heads, useable as a loom for weaving the present woven plastic bag fabric, is depicted.

This figure further shows a rectangular wooden frame (62) with a first side (64*a*) and a second side (64*b*) opposite the first side (64*a*). The frame (62) also has a third side (64*c*) opposite a fourth side (64*d*).

Each side (64*a*, 64*b*, 64*c* and 64*d*) can range in width from about 1 inch to about 1.25 inches and can have any length, depending on the desired dimensions of the sheet of woven plastic bag fabric to be produced. For example, the generally rectangular wooden frame (62) can have a length of 24 inches, a width of 18 inches, and a thickness of 0.75 inches. The frame (62) can also be a square.

In an embodiment, the frame (62) can be made from other rigid materials, such as injection molded hard plastic obtained from recycled water bottles.

The first side (64*a*) is depicted having a row of fourteen first longitudinal posts with heads (24*a* through 24*n*). The third side (64*c*) is depicted having a row of fourteen left edge posts with heads (40*a* through 40*n*). The fourth side (64*d*) is depicted having a row of fourteen right edge posts with heads (42*a* through 42*n*).

While first side (64*a*), third side (64*c*), and fourth side (64*d*) are depicted having fourteen posts with heads, it should be noted that the depicted frame (62), where each side (64*a*, 64*c* and 64*d*) can have any number of posts with heads, ranging from about 10 to about 150 or more posts with heads. For example, a frame with a third and fourth sides having 50 posts with heads and first and second sides having 70 posts with heads can be contemplated to be useable to produce a sheet of woven plastic bags approximately 1.5 feet by 2 feet in about one hour.

The second side (64*b*) is depicted having a row of seven non-moveable longitudinal posts with heads (26*a* through 26*g*) and a row of seven moveable longitudinal posts with heads (30*a* through 30*g*) disposed toward the interior of the generally rectangular wooden frame (62) from the non-moveable longitudinal posts with heads (26*a* through 26*g*).

While the second side (64*b*) is depicted having seven moveable posts with heads and seven non-moveable posts with heads, it is contemplated that second side (64*b*) can have any number of posts with heads, depending on the desired size of the finished sheet of woven plastic bag fabric, such as 25 moveable posts with heads and 25 non-moveable posts with heads for producing a sheet approximately 1.5 feet by 2 feet in about one hour.

Each non-moveable longitudinal post with a head (26*a* through 26*g*) and each moveable longitudinal post with a head (30*a* through 30*g*) is depicted as a nail having a second head disposed beneath its top, defining a groove for securing ribbons of plastic bags against vertical sliding.

Each post with a head can be a metal post with a head, such as a nail. Each post with a head can also be made from other materials, such as wood or molded plastic. Each post with a head can range in height from about 0.5 inches to about 3 inches, and each head can range in diameter from about 0.125 inches to about 0.5 inches.

Each post with a head can be spaced from each adjacent post with a head by a space, such as about 0.25 inches. The spacing between each post with a head can be varied depending on the width of the flexible ribbons of plastic bags used to form the woven plastic bag fabric and on the desirability of spaces within the finished sheet of woven plastic bag fabric.

A moveable bar (66) can be disposed over the second side (64*b*). Each movable longitudinal post with a head (30*a* through 30*g*) can be non-removably affixed to the moveable bar (66). Each non-moveable longitudinal post with a head (26*a* through 26*g*) can penetrate through the moveable bar (66) to engage the second side (64*b*).

The moveable bar (66) can have dimensions identical to those of the second side (64*b*), or the moveable bar (66) can be slightly longer than the second side (64*b*), extending beyond the length of the generally rectangular wooden frame (62).

The moveable bar (66) can be contemplated to be slidable along the non-moveable longitudinal posts (26*a* through 26*g*), such that the moveable bar (66) can be raised and lowered, causing each moveable longitudinal post with a head (30*a* through 30*g*) to be raised and lowered, while each non-moveable longitudinal post with a head (26*a* through 26*g*) remains stationary.

A first eye (72) and a second eye (74), which can be plastic or metal hooks, can be secured to the moveable bar (66) for holding a rod (76), which can function as a holder for ribbon while weaving a sheet of the woven plastic bag fabric.

The rod (76) can have a length equal to that of the moveable bar (66), a greater length, or a smaller length that is no smaller than the distance between the first eye (72) and the second eye (74). The rod can have any diameter that can be accommodated by the diameter of the first eye (72) and the second eye (74), such as about 0.25 inches. The rod can be made from wood, plastic, metal, or another generally stiff material.

Figure 2:
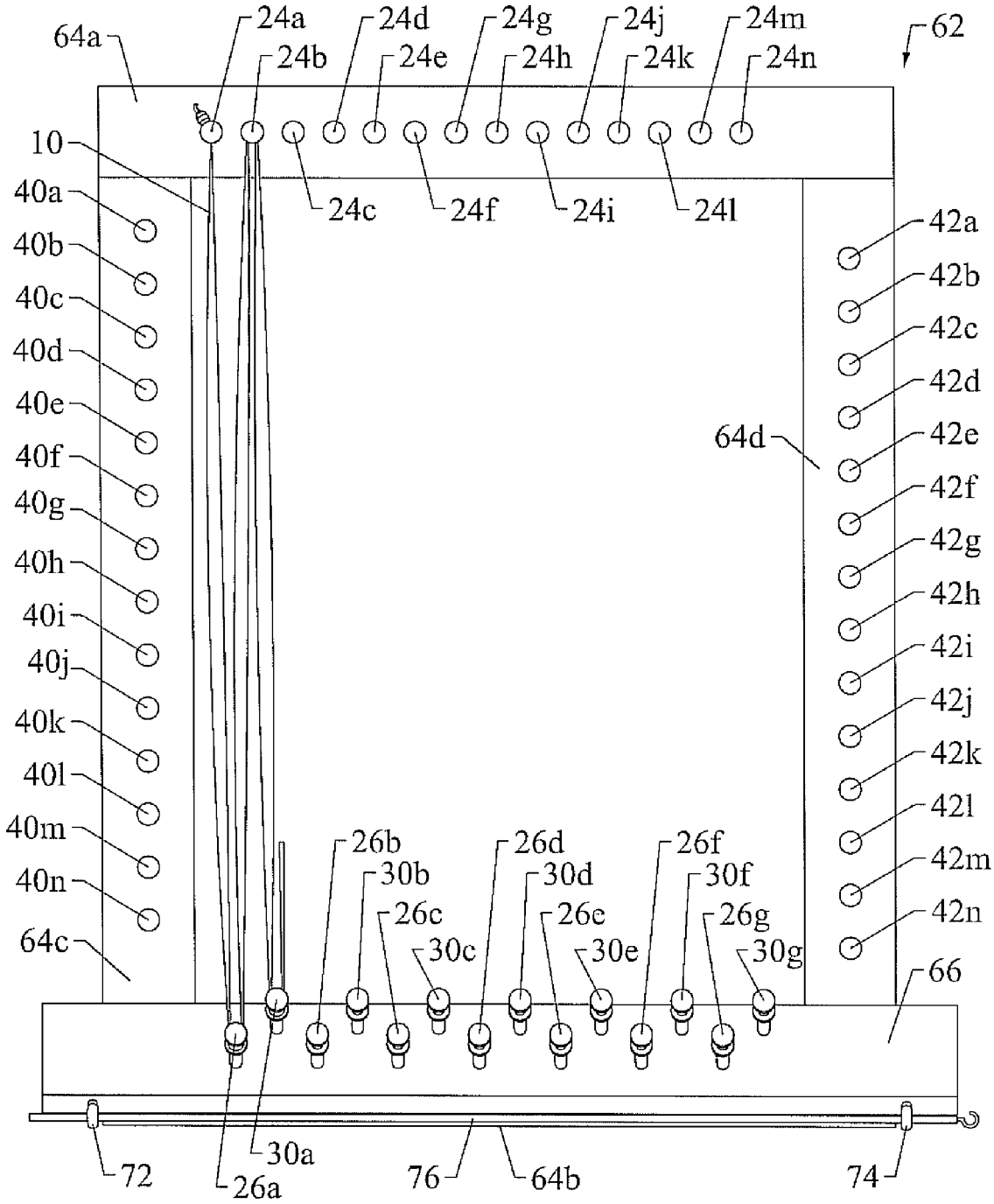
FIG. 2 depicts the frame of FIG. 1 with a longitudinal flexible ribbon of connected plastic bags wrapped around four longitudinal posts with heads.

Referring now to FIG. 2, the generally rectangular wooden frame (62) of FIG. 1 is depicted partially engaged with a longitudinal flexible ribbon of connected plastic bags (10).

Generally rectangular wooden frame (62) has first side (64*a*) with first longitudinal posts with heads (24*a* through 24*n*), third side (64*c*) with left edge posts with heads (40*a* through 40*n*), fourth side (64*d*) with right edge posts with heads (42*a* through 42*n*), and second side (64*b*) with moveable longitudinal posts with heads (30*a* through 30*g*) and non-moveable longitudinal posts with heads (26*a* through 26*g*).

Moveable bar (66) is shown disposed over second side (64*b*). First eye (72) and second eye (74) can be secured to moveable bar (66) and contain rod (76).

A longitudinal flexible ribbon of connected plastic bags (10) is shown tied to first longitudinal post with a head (24*a*). The longitudinal flexible ribbon of connected plastic bags (10) is further shown wrapped around first non-moveable longitudinal post with a head (26*a*), then wrapped around second longitudinal post with a head (24*b*). The longitudinal flexible ribbon of connected plastic bags (10) is also shown wrapped around first moveable longitudinal post with a head (30*a*).

The engagement of the longitudinal flexible ribbon of connected plastic bags (10) with first and second longitudinal posts with heads (24*a* and 24*b*), with first non-moveable longitudinal post with a head (26*a*), and with first moveable longitudinal post with a head (30*a*) can be repeated throughout all remaining longitudinal posts with heads (24*b* through 24*n*), all remaining non-moveable longitudinal posts with heads (26*b* through 26*g*), and all remaining moveable longitudinal posts with heads (30*b* through 30*g*).

The longitudinal flexible ribbon of connected plastic bags (10) can be made from polyethylene or other kinds of plastic, including strips of plastic grocery bags, and can range in width from about 0.5 inches to about 4 inches.

It is contemplated that the longitudinal flexible ribbon of connected plastic bags (10) can maintain its shape, stretching only about 3 percent of its length or less. The longitudinal flexible ribbon of connected plastic bags (10) can have any continuous length, depending on the desired size of the completed sheet of woven plastic bag fabric.

Figure 3:
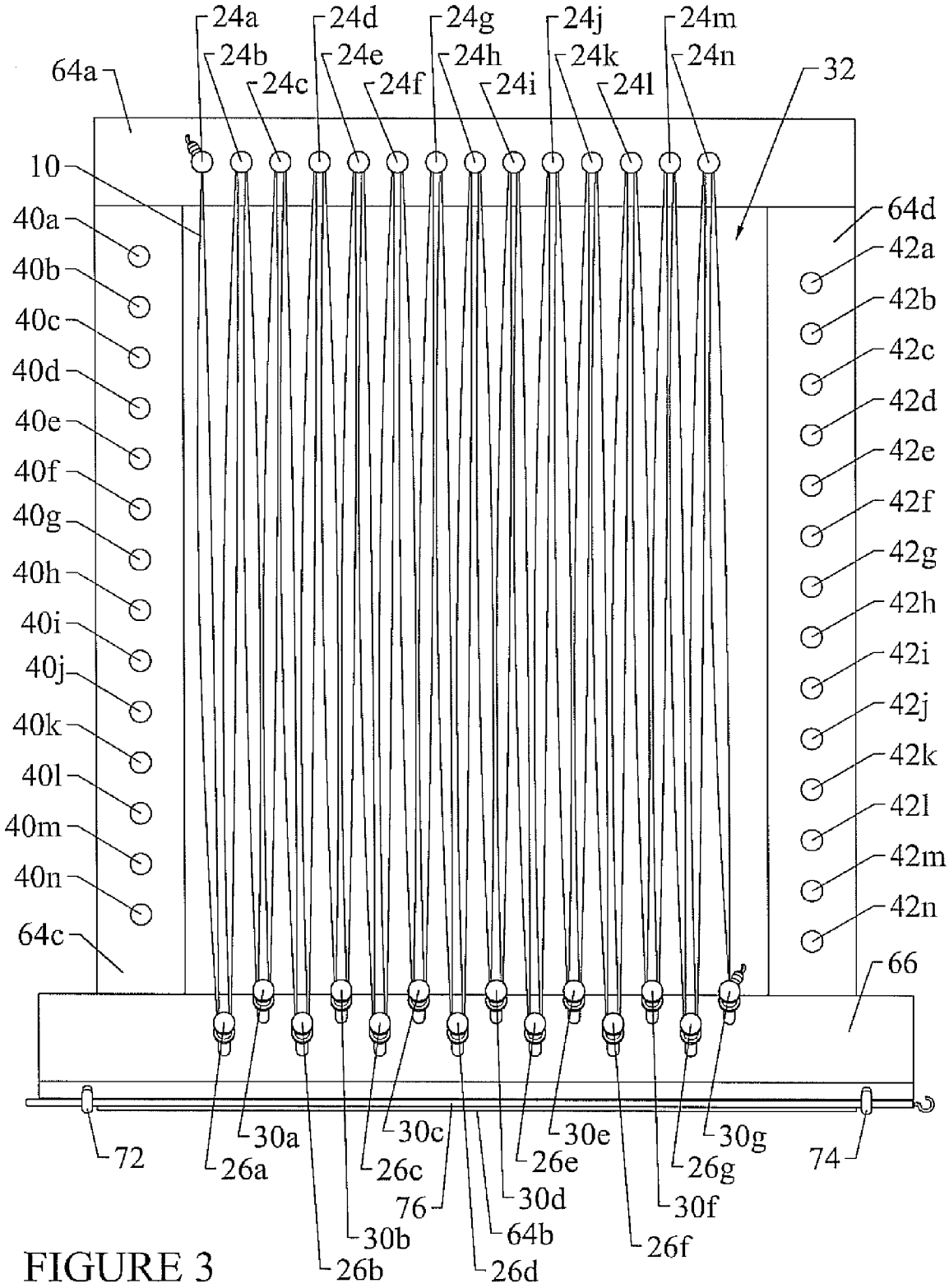
FIG. 3 depicts the frame of FIG. 2 with the longitudinal flexible ribbon of connected plastic bags wrapped around each longitudinal post with a head.

Referring now to FIG. 3, the generally rectangular wooden frame (62) of FIG. 2 is depicted with the longitudinal flexible ribbon of connected plastic bags (10) engaging each post along first side (64*a*) and second side (64*b*).

First side (64*a*) is shown having longitudinal posts with heads (24*a* through 24*n*), third side (64*c*) is shown having left edge posts with heads (40*a* through 40*n*), and fourth side (64*d*) is shown having right edge posts with heads (42*a* through 42*n*). Second side (64*b*) is shown having non-moveable longitudinal posts with heads (26*a* through 26*g*) and moveable longitudinal posts with heads (30*a* through 30*g*).

Longitudinal flexible ribbon of connected plastic bags (10) is shown tied to first longitudinal post with a head (24*a*), then alternating and sequentially wrapped around each non-moveable longitudinal post with a head (26*a* through 26*g*), each remaining longitudinal post with a head (24*b* through 24*n*), and each moveable longitudinal post with a head (30*a* through 30*g*). The longitudinal flexible ribbon of connected plastic bags (10) is tied to the seventh moveable longitudinal post with a head (30*g*).

The engagement of the longitudinal flexible ribbon of connected plastic bags (10) with each longitudinal post with a head (24*a* through 24*n*), each non-moveable longitudinal post with a head (26*a* through 26*g*), and each moveable longitudinal post with a head (30*a* through 30*g*) forms a plurality of longitudinal rows of ribbon (32).

Figure 4A:
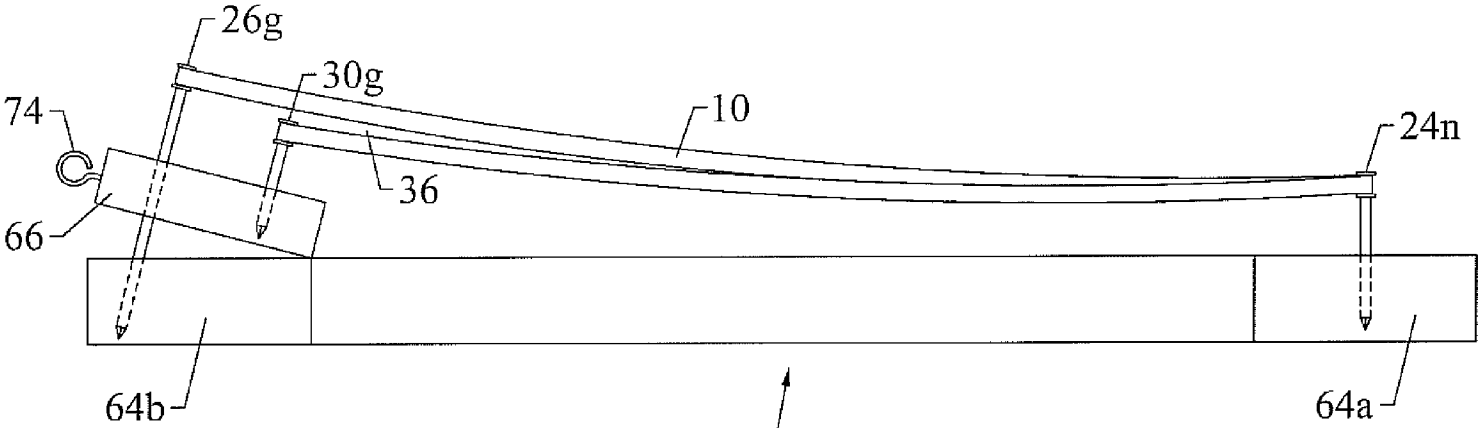
FIG. 4A depicts a side view of the frame of FIG. 3 having a vertical space for threading a second flexible ribbon of connected plastic bags.

FIG. 4A depicts a side view of the generally rectangular wooden frame (62) of FIG. 3 with the longitudinal flexible ribbon of connected plastic bags (10) secured to each longitudinal post with a head.

FIG. 4A shows rectangular wooden frame (62) with first side (64*a*). Fourteenth longitudinal post with a head (24*n*) is visible in this view. Second side (64*b*) is shown with moveable bar (66) disposed thereon and in a lowered position. Second eye (74) is visible in this view, secured to moveable bar (66).

Seventh non-moveable longitudinal post with a head (26*g*) is shown penetrating through moveable bar (66) to secure to second side (64*b*), such that seventh non-moveable longitudinal post with a head (26*g*) does not move when moveable bar (66) is raised or lowered.

Seventh moveable longitudinal post with a head (30*g*) is shown secured to movable bar (66), such that seventh moveable longitudinal post with a head raises and lowers as moveable bar (66) is raised and lowered along the non-movable longitudinal posts with heads.

Longitudinal flexible ribbon of connected plastic bags (10) is shown wrapped around fourteenth longitudinal post with a head (24*n*), seventh non-moveable longitudinal post with a head (26*g*), and seventh moveable longitudinal post with a head (30*g*).

The lowering of the moveable bar (66) into a lowered position, thereby lowering seventh moveable longitudinal post with a head (30*g*), creates a vertical space (36) between the portion of the longitudinal flexible ribbon of connected plastic bags (10) secured around seventh non-moveable longitudinal post with a head (26*g*) and the portion of the longitudinal flexible ribbon of connected plastic bags (10) secured around seventh moveable longitudinal post with a head (30*g*).

The vertical space (36) can be contemplated to be used for threading a transverse flexible ribbon of connected plastic bags between the plurality of longitudinal rows of ribbon in an interlaced fashion.

Figure 4B:
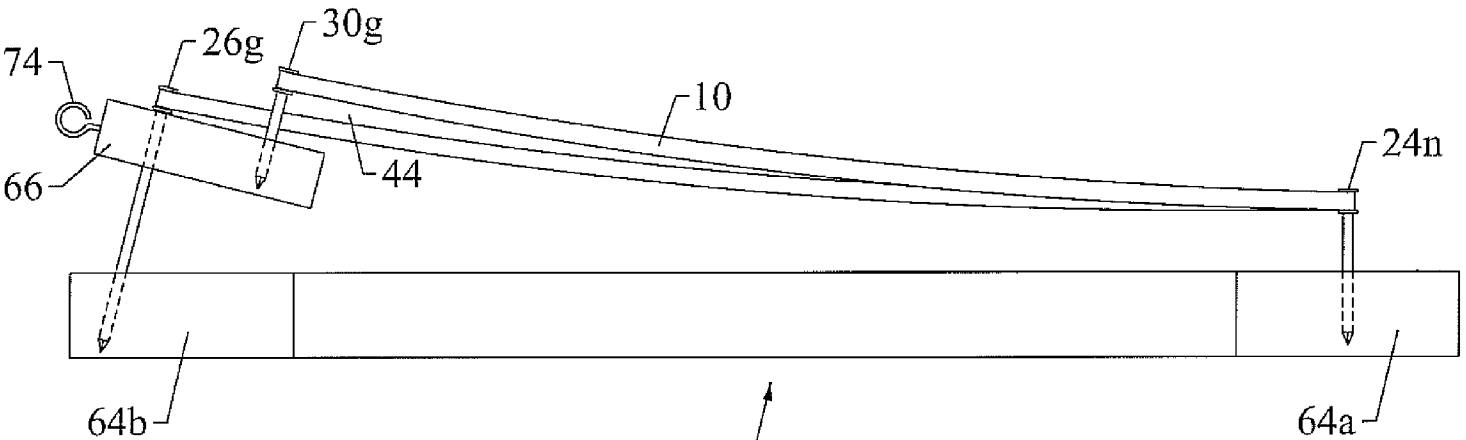
FIG. 4B depicts the frame of FIG. 4A with a moveable bar in an alternate position forming a second vertical space for threading the second flexible ribbon of connected plastic bags.

FIG. 4B shows the generally rectangular wooden frame (62) of FIG. 4A, shown with movable bar (66) in a raised position.

Generally rectangular wooden frame (62) is shown with first side (64*a*) having fourteenth longitudinal post with a head (24*n*) visibly secured thereon. Second side (64*b*) is shown with moveable bar (66) disposed thereon in a raised position. Second eye (74) is visible in this view, secured to moveable bar (66).

Seventh non-moveable longitudinal post with a head (26*g*) is shown penetrating through moveable bar (66) to secure to second side (64*b*). Seventh moveable longitudinal post with a head (30*g*) is shown secured to movable bar (66).

Longitudinal flexible ribbon of connected plastic bags (10) is shown wrapped around fourteenth longitudinal post with a head (24*n*), seventh non-moveable longitudinal post with a head (26*g*), and seventh moveable longitudinal post with a head (30*g*).

The raising of the moveable bar (66) into a raising position, thereby raising seventh moveable longitudinal post with a head (30*g*), creates a second vertical space (44) between the portion of the longitudinal flexible ribbon of connected plastic bags (10) secured around to seventh moveable longitudinal post with a head (30*g*) and the portion of the longitudinal flexible ribbon of connected plastic bags (10) secured around seventh non-moveable longitudinal post with a head (26*g*).

The second vertical space (44) can be used for threading a transverse flexible ribbon of connected plastic bags in an interlaced fashion with the plurality of longitudinal rows, opposite the interlaced fashion when threaded through the first vertical space (36, visible in FIG. 4A).

Figure 5:
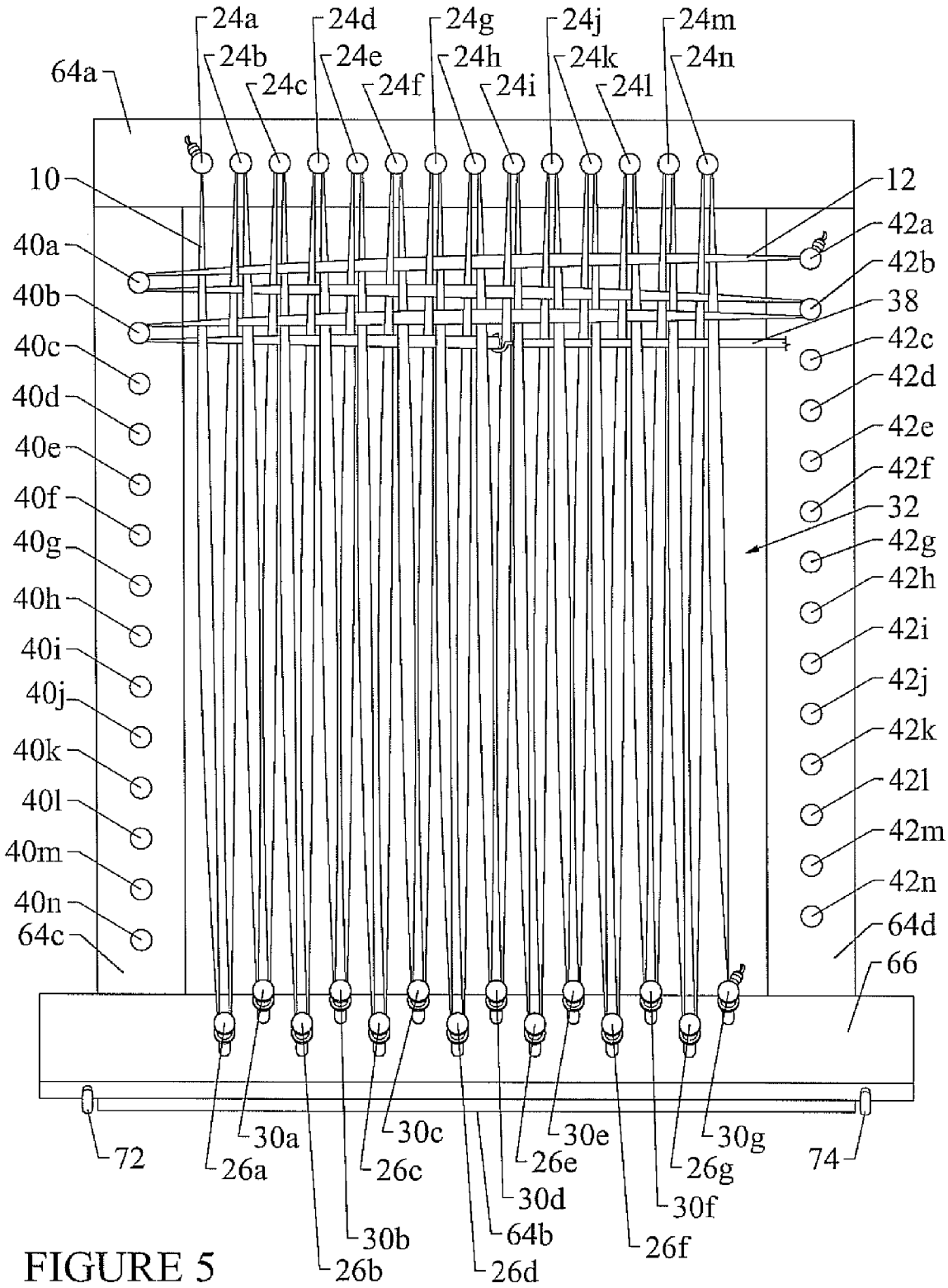
FIG. 5 depicts the frame of FIG. 3 with a transverse flexible ribbon of connected plastic bags wrapped around four edge posts with heads.

Referring now to FIG. 5, a top view of the generally rectangular wooden frame (62) of FIG. 3 is shown partially engaging a transverse flexible ribbon of connected plastic bags (12).

Generally rectangular wooden frame (62) is shown having first side (24*a*) with first longitudinal posts with heads (24*a* through 24*n*), third side (64*c*) with left edge posts with heads (40*a* through 40*n*), fourth side (64*d*) with right edge posts with heads (42*a* through 42*n*), and second side (64*b*) with moveable longitudinal posts with heads (30*a* through 30*g*) and non-moveable longitudinal posts with heads (26*a* through 26*g*).

Moveable bar (66) is disposed over second side (64*b*). First eye (72) and second eye (74) are secured to moveable bar (66).

Longitudinal flexible ribbon of connected plastic bags (10) is shown tied to first longitudinal post with a head (24*a*), then sequentially wrapped around each non-moveable longitudinal post with a head (26*a* through 26*g*), each remaining longitudinal post with a head (24*b* through 24*n*), and each moveable longitudinal post with a head (30*a* through 30*g*). The longitudinal flexible ribbon of connected plastic bags (10) is tied to the seventh moveable longitudinal post with a head (30*g*), forming a plurality of longitudinal rows of ribbon (32).

A transverse flexible ribbon of connected plastic bags (12) is shown tied to the first right edge post with a head (42*a*), then wrapped around the first left edge post with a head (40*a*). The transverse flexible ribbon of connected plastic bags (12) is further wrapped around the second right edge post with a head (42*b*) and second left edge post with a head (40*b*).

Transverse flexible ribbon of connected plastic bags (12) is shown threaded to a dowel (38), which can be a thin wooden, plastic, or metal rod having a hook, nail, clip, or similar engaging means for securing to the transverse flexible ribbon of connected plastic bags (12) and threading the transverse flexible ribbon of connected plastic bags (12) between the plurality of longitudinal rows (32).

The dowel (38) is used to thread the transverse flexible ribbon of connected plastic bags (12) through the first and second vertical spaces (36 and 44—not visible in this view), thereby interlacing the transverse flexible ribbon of connected plastic bags (12) with the plurality of longitudinal rows (32).

The transverse flexible ribbon of connected plastic bags (12) can be sequentially and alternating threaded through the first vertical space and the second vertical space, which are formed by raising and lowering moveable bar (66), forming a completed sheet of woven plastic bag fabric by interlacing the transverse flexible ribbon of connected plastic bags (12) with the longitudinal flexible ribbon of connected plastic bags (10).

Figure 6:
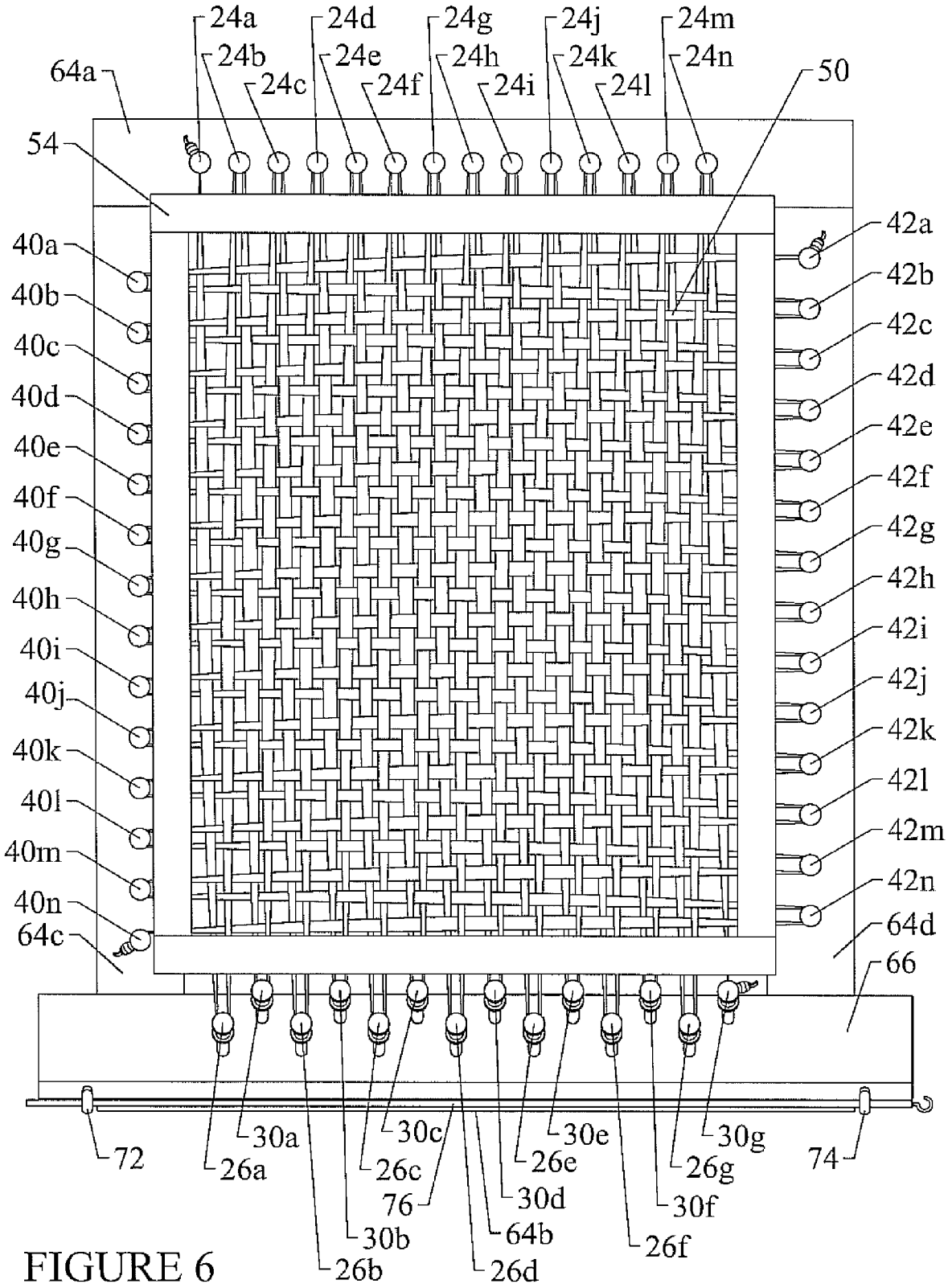
FIG. 6 depicts the frame of FIG. 5 having a completed sheet of woven plastic bag fabric with an adhesive tape disposed along the perimeter of the sheet.

Referring now to FIG. 6, the generally rectangular wooden frame (62) of FIG. 5 is shown having a completed sheet of woven plastic bag fabric secured thereon.

Generally rectangular wooden frame (62) is shown having first side (64*a*) with first longitudinal posts with heads (24*a* through 24*n*), third side (64*c*) with left edge posts with heads (40*a* through 40*n*), fourth side (64*d*) with right edge posts with heads (42*a* through 42*n*), and second side (64*b*) with moveable longitudinal posts with heads (30*a* through 30*g*) and non-moveable longitudinal posts with heads (26*a* through 26*g*).

The generally wooden frame, in an embodiment can be made from four prefabricated stretcher strips, that can be wooden and can easily fit together. The benefit of using prefabricated stretcher strips, which can be found in arts supply stores for stretching canvas, is that these strips come in premade sizes, so a factory having many users, can produce a consistently shaped woven fabric with these consistently shaped prefabricated frames.

Another advantage of the prefabricated stretcher strips is that they are easily assembled and disassembled, easily shipped, and easily carried to a home or small workspace where an individual or groups of individuals can use the loom to generate a product for sale.

Another advantage of the prefabricated stretcher strips is that the strips can be inexpensive to make.

Still another advantage of the prefabricated stretcher strips is that the frame can be built in about half the time of the conventional wooden frames that can require sawing, and cutting.

A longitudinal flexible ribbon of connected plastic bags and a transverse flexible ribbon of connected plastic bags can be woven in an interlaced fashion, forming a sheet of woven plastic bag fabric (50).

An adhesive tape (54) is shown adhered to the perimeter of the sheet of woven plastic bag fabric (50) at a position toward the interior of the generally wooden rectangular frame (62) from each of the posts with heads.

It is contemplated that the portions of the sheet of woven plastic bag fabric (50) can be secured to each of the posts with heads can then can be cut, while the sheet of woven plastic bag fabric (50) remains adhered to the adhesive tape (54), allowing the adhesive tape (54) to function as an edging of the sheet of woven plastic bag fabric (50).

Multiple sheets of woven plastic bag fabric can be created in this manner and can be sewn together to form articles using the edging formed by the adhesive tape (54).

In an embodiment, it is contemplated that the right edge posts with heads, the left edge posts with heads and the longitudinal posts with heads can be plastic push pins. These push pins can be from an office supply store. These push pins can have a metal shaft over which a plastic head is disposed for lightweight and easy insertion into the frame. The push pins can have the benefit of being light weight. The looms can then be simple to produce. The looms are less expensive to manufacture than with nails, and no rusting occurs, which for humid climates like Costa Rica or Mexico, this is a significant safety benefit for the workers. Also by using the push pin embodiment, the weave is more consistent, as all the push pins are identical, and the push pins can be properly positioned, because the edges of the push pins can touch, while letting the weaver weave the plastic bag ribbon around the push pins.

In an embodiment, two rows of push pins can be used for the right edge posts and the left edge posts to make the loom, wherein a top row of push pins can be oriented at an angle offset from a bottom row. In an embodiment, as the right edge posts, the top row can be created with all pin heads touching each other then a second row can be formed below and adjacent the top row, wherein the second row push pins can be positioned so that each edge of the second push pin is disposed at the center of the first row of push pins, creating a tightly positioned pair of rows, with one set of push pins offset from the second set of push pins. In this embodiment, all push pin heads can touch each other for a consistent weave.

Figure 7A:
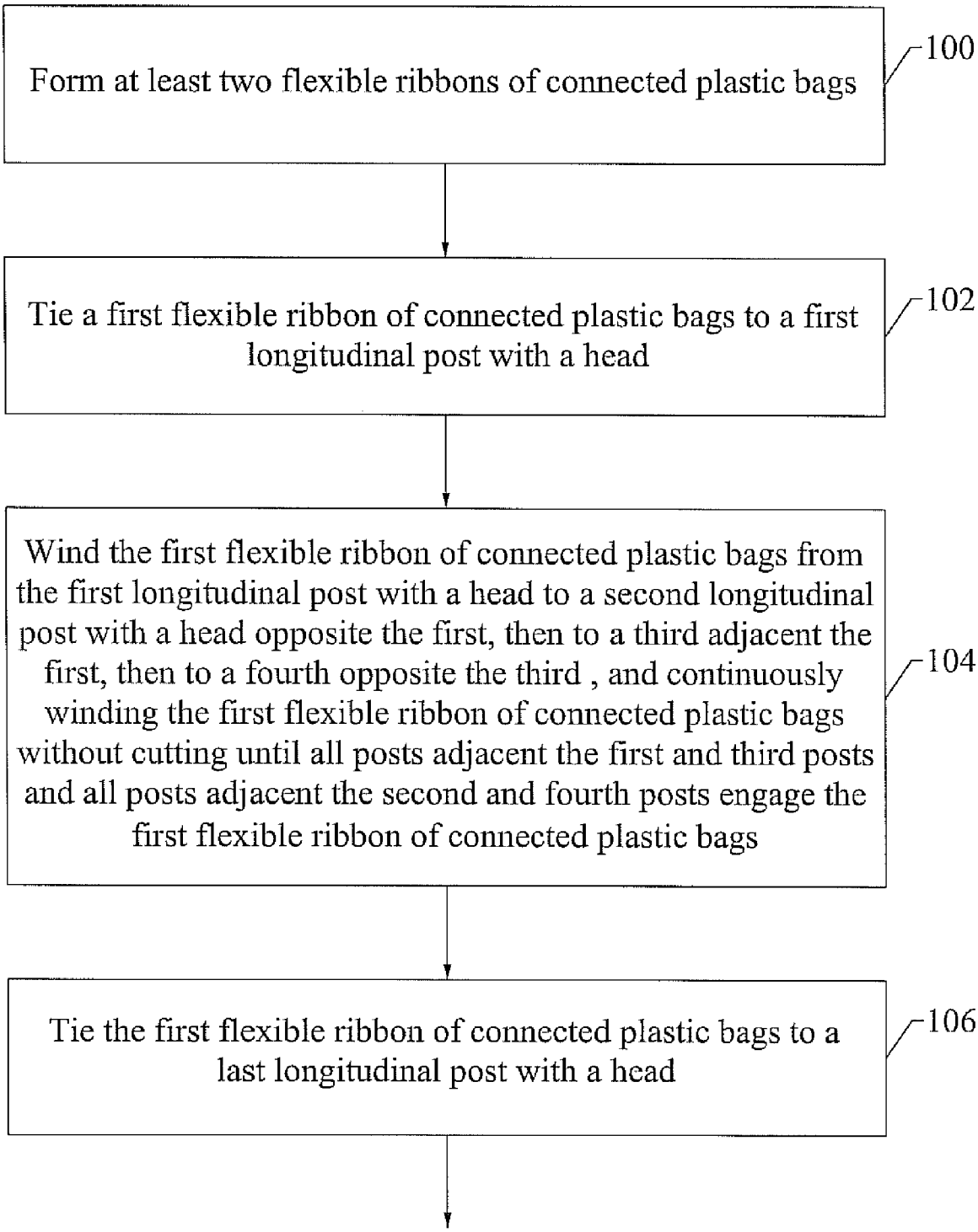
FIG. 7A depicts a flow diagram of a first part of an embodiment of the present method for making a sheet of woven plastic bag fabric.

Referring now to FIG. 7A, a diagram depicting the steps of a first part of an embodiment of the present method for making a sheet of the woven plastic bag fabric is shown.

The depicted embodiment begins by forming at least two flexible ribbons of connected plastic bags (100). It is contemplated that one flexible ribbon of connected plastic bags can be used as a longitudinal flexible ribbon of connected plastic bags, while a second can be used as a transverse flexible ribbon of connected plastic bags.

A first flexible ribbon of connected plastic bags can be tied to a first longitudinal post with a head (102).

The flexible ribbon of connected plastic bags can then be wound from the first longitudinal post with a head to a second longitudinal post with a head opposite the first, then to a third adjacent the first, then to a fourth adjacent the second and opposite the third, and then continuously wound without cutting until all posts adjacent the first, third, second, and fourth posts engage the first flexible ribbon of connected plastic bags (104).

The first flexible ribbon of connected plastic bags can then be tied to a last longitudinal post with a head (106).

Figure 7B:
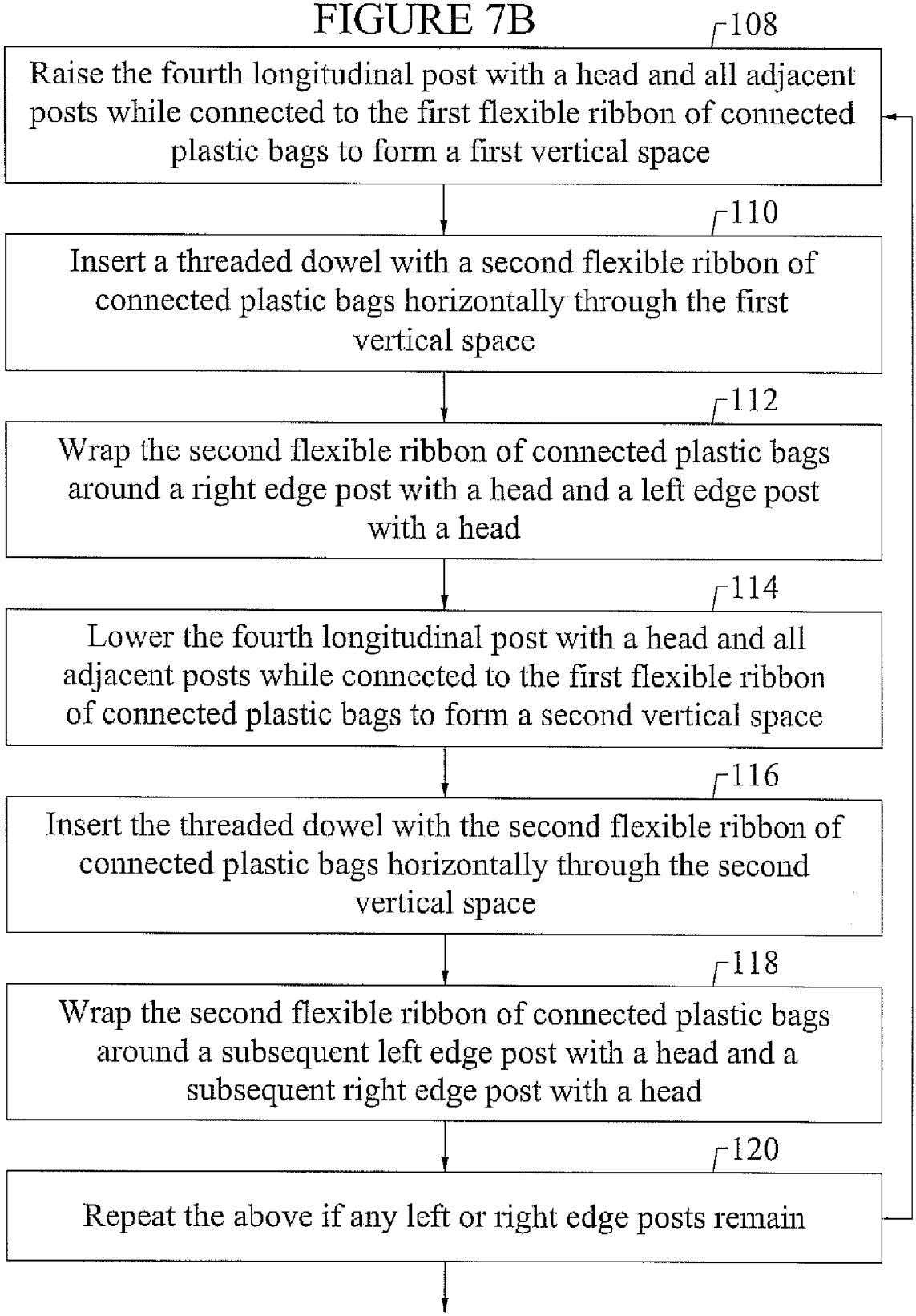
FIG. 7B depicts a flow diagram of a second part of the embodiment of the present method of FIG. 7A.

Referring now to FIG. 7B, a flow diagram of a second part of the method depicted in FIG. 7A is shown.

The fourth longitudinal post with a head and all adjacent posts can be raised while connected to the first flexible ribbon of connected plastic bags, forming a first vertical space (108).

A threaded dowel with a second flexible ribbon of connected plastic bags can then be inserted horizontally through the first vertical space (110).

The second flexible ribbon of connected plastic bags can then be wrapped around a right edge post with a head and a left edge post with a head opposite the right edge post with a head (112).

The fourth longitudinal post with a head and all adjacent posts can then be lowered while connected to the first flexible ribbon of connected plastic bags, forming a second vertical space (114).

The threaded dowel with the second flexible ribbon of connected plastic bags can be inserted horizontally through the second vertical space (116).

The second flexible ribbon of connected plastic bags can then be wrapped around a subsequent left edge post with a head and a subsequent right edge post with a head (118).

If any left edge or right edge posts remain, steps 108 through 118 can be repeated (120).

Figure 7C:
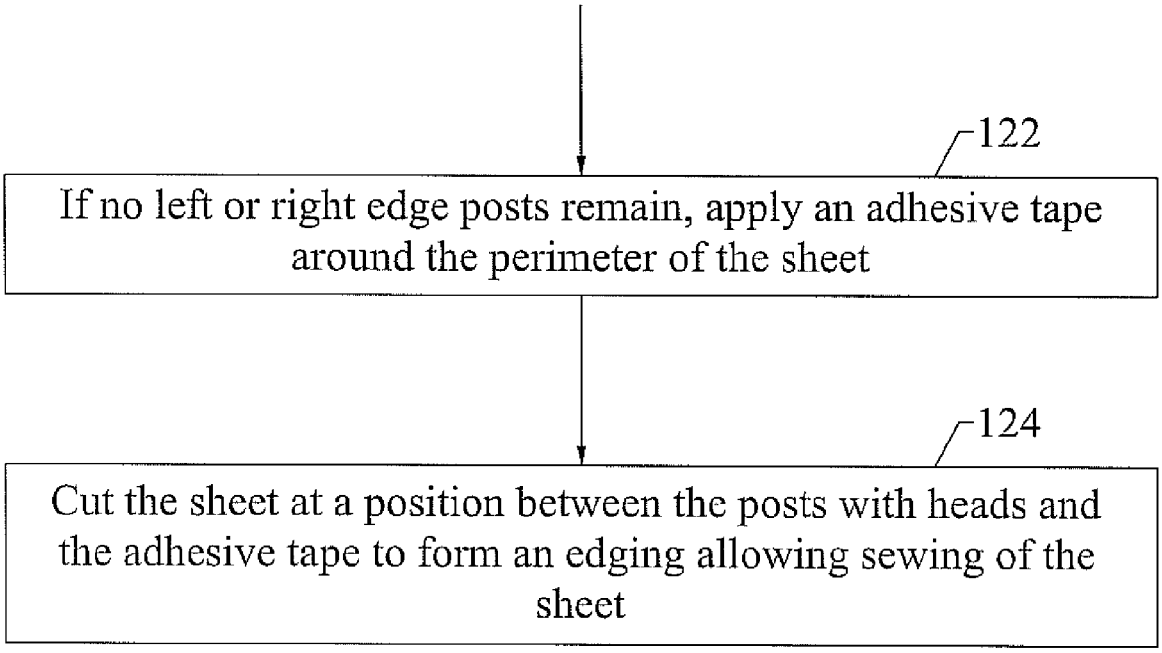
FIG. 7C depicts a flow diagram of a third part of the embodiment of the present method shown in FIGS. 7A and 7B.

Referring now to FIG. 7C, FIG. 7C is a flow diagram depicting a third part of the method shown in FIG. 7A and 7B, which is performed after all left and right edge posts have been engaged with the second flexible ribbon of connected plastic bags.

When no left or right edge posts remain, an adhesive tape can be applied around the perimeter of the completed sheet (122).

The sheet can then be cut at a position between the posts with heads and the adhesive tape to form an edging allowing sewing of the sheet (124).

While these embodiments have been described with emphasis on the embodiments, it should be understood that within the scope of the appended claims, the embodiments might be practiced other than as specifically described herein.

What is claimed is:

1. A method for producing a woven plastic bag sheet comprised of flexible ribbons of plastic bags, the method comprising the steps of:

a. forming a fast assembly, light weight, wooden loom for weaving comprising a frame by:

i. forming a first side of a loom by positioning a moveable bar over a 1st frame side, wherein the moveable frame is of substantially the same size as the base frame;

ii. drilling a first row of holes through the moveable bar and into the 1st frame;

iii. drilling a second row of holes parallel to and offset from the first row of holes through the moveable bar;

iv. inserting a plurality of long posts each comprising a long shaft with head through the first row of holes, enabling the moveable bar to slide up and down on the long shaft;

v. inserting a plurality of short posts each with a short shaft and head through the second row of holes providing a fixed support for winding ribbon for weaving;

vi. forming a second side of the loom by disposing a plurality of left edge posts with heads into a second frame side;

vii. forming a third side of the loom by disposing a plurality of right edge posts with heads into a third frame side;

viii. forming a fourth side of the loom by disposing a plurality of right edge posts with heads into a fourth frame side; and ix. connecting the second and third sides to the first side, and the fourth side to the second and third sides forming the loom;

b. forming at least two flexible ribbons of connected plastic bags, wherein the at least one flexible ribbon of connected plastic bags, wherein the ribbon is resistant to stretching during use to no more than 3 percent of the length of the flexible ribbon of connected plastic bags prior to use, and wherein the flexible plastic ribbon of connected plastic bags has a width ranging from 0.25 inches to 4 inches;

c. tying a first of the flexible ribbons of connected plastic bags to a first longitudinal post with a head on the fourth frame side;

d. winding the first flexible ribbon of connected plastic bags from the first longitudinal post with a head to a long post on the first frame side opposite the first longitudinal post with a head and then to a second longitudinal post with a head in the fourth frame side adjacent the first longitudinal post with a head opposite the longitudinal post with a head, and then to a short post positioned offset from the long post and opposite the third longitudinal post with a head and continuing to wind the first flexible ribbon of connected plastic bags without cutting from the fourth frame to first a long post, and then adjacent short post, until all posts disposed in first and fourth frame sides are used forming a plurality of longitudinal rows of ribbon;

e. tying the flexible ribbon of connected plastic bags to a last longitudinal post with a head in the fourth frame;

(1) raising the moveable while connected to the first flexible ribbon of connected plastic bags to form a first vertical space between the flexible ribbon of connected plastic bags connected to the long posts and the flexible ribbon connected to the short posts;

(2) inserting a threaded dowel with a second flexible ribbon of connected plastic bags horizontally through the first vertical space;

(3) tying the threaded second flexible ribbon of connected plastic bags around a first right edge post with a head positioned 90 degrees to the first post of the fourth frame;

(4) wrapping the threaded second flexible ribbon of connected plastic bags around a first left edge post with a head positioned 90 degrees to the first post with a head;

(5) lowering the fourth longitudinal post with a head and all posts with a head adjacent to the fourth longitudinal post with a head to form a second vertical space;

(6) inserting the threaded dowel with the second flexible ribbon of connected plastic bags horizontally through the second vertical space;

(7) wrapping the threaded second flexible ribbon of connected plastic bags around a subsequent right edge post with a head;

(8) wrapping the threaded second flexible ribbon of connected plastic bags around a subsequent left edge post with a head; and (9) repeating steps (1) through (8) until all posts with heads are wrapped with the second flexible ribbon of connected plastic bags forming a sheet;

f. applying an adhesive tape around the perimeter of the sheet; and g. cutting the first flexible ribbon of connected plastic bags and the second flexible ribbon of connected plastic bags from all the posts with heads at a position between the posts with heads and the adhesive tape, wherein the adhesive tape forms an edging; allowing sewing of the sheet, forming a finished sheet in under one hour.

2. The method of claim 1, wherein the long and short posts with heads are nails.

3. The method of claim 1, wherein the long posts are between 2 inches and 4 inches in length and the short posts are between 1 inch and 1.5 inches in length.

4. The method of claim 1, wherein the short posts are push pins mounted on a wooden strip secured to the moveable frame.

5. The method of claim 1, wherein the first, second and third longitudinal posts can be push pins.

6. The method of claim 1, wherein the frame of the formed wooden loom is square or rectangular.

7. The method of claim 3, wherein the long post with a head is positioned adjacent the short post with a head at an offset location between 0.25 inches and 0.5 inches along the thread axis from a plane between the long and short posts.

8. The method of claim 1, wherein a ratio of space between right edge and left edge posts and width of the at least one flexible ribbon of connected plastic bags is 1:2.

9. The method of claim 1, wherein the space between the right and left edge posts is the same width as the at least one flexible ribbon of connected plastic bags.

10. The method of claim 1, further comprising a first eye connected to one end of the moveable bar and a second eye connected to a second end of the moveable bar in the same plane as the first eye, and wherein a rod is disposed through and between the eyes forming a holder for ribbon during weaving.

11. The method of claim 1, wherein push pins are used for all the right edge, left edge, and longitudinal posts.

12. The method of claim 1, wherein prefabricated stretcher strips are used for the base, second, third and fourth frame sides in forming the loom.

13. The method of claim 1, further comprising sewing a threaded seam over the adhesive edging.

* * * * *